US010992034B1

(12) United States Patent
Yang

(10) Patent No.: US 10,992,034 B1
(45) Date of Patent: Apr. 27, 2021

(54) ANTENNA ELEMENT AND ANTENNA

(71) Applicant: SHENZHEN ANTOP TECHNOLOGY CO., LTD., Shenzhen (CN)

(72) Inventor: Ruidian Yang, Shenzhen (CN)

(73) Assignee: Shenzhen Antop Technology Co., LTD, Shenzhen (CN)

( * ) Notice: Subject to any disclaimer, the term of this patent is extended or adjusted under 35 U.S.C. 154(b) by 0 days.

(21) Appl. No.: 16/927,926

(22) Filed: Jul. 13, 2020

(30) Foreign Application Priority Data

Jun. 9, 2020 (CN) ..... 202021051369.2

(51) Int. Cl.
*H01Q 1/36* (2006.01)
*H01Q 1/24* (2006.01)

(52) U.S. Cl.
CPC ..... *H01Q 1/36* (2013.01); *H01Q 1/24* (2013.01)

(58) Field of Classification Search
CPC .. H01Q 1/24; H01Q 1/36; H01Q 1/38; H01Q 5/371; H01Q 5/385; H01Q 9/04; H01Q 9/045
See application file for complete search history.

(56) References Cited

U.S. PATENT DOCUMENTS 3,475,759 A * 10/1969 Winegard ..... H01Q 1/1228 343/815
3,653,056 A * 3/1972 Peterson ..... H01Q 5/49 343/795
4,860,019 A * 8/1989 Jiang ..... H01Q 1/38 343/795
2010/0026581 A1* 2/2010 Chen ..... H01Q 5/371 343/700 MS
2015/0070239 A1* 3/2015 Hung ..... H01Q 1/243 343/848
2015/0097752 A1* 4/2015 Li ..... H01Q 5/321 343/848

* cited by examiner

*Primary Examiner* — Thai Pham
(74) *Attorney, Agent, or Firm* — Robert L. Stearns; Dickinson Wright, PLLC

(57) ABSTRACT

An antenna element, including: a first trunk and a second trunk arranged oppositely, a plurality of first branches connecting the first trunk, and a plurality of second branches connecting the second trunk. The first trunk includes a first narrow segment and a first wide segment connecting the first narrow segment, and the second trunk includes a second narrow segment and a second wide segment connecting the second narrow segment. The first narrow segment is disposed opposite to the second narrow segment, the first wide segment is disposed opposite to the second wide segment. The first wide segment defines a first feed hole, the second wide segment defines a second feed hole at a position opposite to the first feed hole.

10 Claims, 4 Drawing Sheets

ANTENNA ELEMENT AND ANTENNA

CROSS-REFERENCE TO RELATED APPLICATION

The present application claims priority to Chinese Patent Applications No. 202021051369.2 filed on Jun. 9, 2020, the entire content of which is incorporated herein by reference in its entirety.

BACKGROUND

Technical Field

The present application relates to the technical field of antenna, in particular to an antenna element and an antenna.

Description of Related Art

Antenna technology has become more and more mature nowadays. Polyline antenna has the characteristics of small area, small volume, light weight, certain flexibility, easy installation and use, etc. It has been widely used in many technical fields. The polyline antenna can be installed on a flexible or rigid substrate by printing, electroplating, etc., and can be deformed as the substrate is deformed, and at the same time, the polyline antenna will hardly affect the signal reception of the antenna, which is deeply favored by the consumer market.

For the antenna, the ability to send and receive signals in various frequency bands is the most important feature. How to optimize the antenna's ability to send and receive signals in each frequency band is also one of the most important topics for engineers. With the popularization of digital TV, consumers have raised higher requirements for the design of wireless band antennas for digital TVs. However, due to structural limitations of traditional polyline antenna, the reception performance of signals in various frequency bands is poor. The achieved effective bandwidth is limited, and the stability of signal reception is poor.

SUMMARY

The purpose of the present application is to provide an antenna element, which aims to solve the technical problem that the conventional antenna element has a large standing wave ratio and poor reception performance.

It is one aspect of the present invention to provide an antenna element. The antenna element comprises a first trunk and a second trunk arranged oppositely, a plurality of the first branches connecting the first trunk, and a plurality of second branches connecting the second trunk; the first trunk comprises a first narrow segment and a first wide segment connecting the first narrow segment, and the second trunk comprises a second narrow segment and a second wide segment connecting the second narrow segment, the first narrow segment is disposed opposite to the second narrow segment, the first wide segment is disposed opposite to the second wide segment; the first wide segment defines a first feed hole, the second wide segment defines a second feed hole at a position opposite to the first feed hole.

According to an embodiment of the present application, the lengths of the first narrow segment and the second narrow segment are equal, and the lengths of the first wide segment and the second wide segment are equal; the ratio of the lengths of the first narrow segment and the first wide segment is between 1:3 and 3:1.

According to an embodiment of the present application, the first narrow segment and the second narrow segment are parallel, and the distance between the first narrow segment and the second narrow segment is 8-10 mm; the first wide segment and the second wide segment are parallel, and the distance between the first wide segment and the second wide segment is 2-2.5 mm.

According to an embodiment of the present application, the first branch comprises a first upper branch and a first lower branch, and the first upper branch is disposed on the side of the first lower branch which is away from the first feed hole, and the first upper branch is a linear structure, and the first lower branch is a polyline structure; the second branch comprises a second upper branch and a second lower branch, the second upper branch is disposed on the side of the second lower branch which is away from the second feed hole, and the second upper branch is a linear structure, and the second lower branch is a polyline structure.

According to an embodiment of the present application, the polyline angle A of the first lower branch meets: $60° \leq A < 180°$; the polyline angle B of the second lower branch is equal to the polyline angle A of the first lower branch.

According to an embodiment of the present application, the antenna element further comprises a frame, the frame is connected to an end of each first branch away from the first trunk, and the frame is connected to one end of each second branch away from the second trunk.

According to an embodiment of the present application, the first feed hole is arranged at an end of the first wide segment away from the first narrow segment, the second feed hole is arranged at an end of the second wide segment away from the second narrow segment; the frame is provided with a notch at a position opposite to the first power feed hole and the second feed hole; the frame comprises an extension for adjusting the resonance frequency of the antenna element, the extension is connected to the edge of the notch, and the extension extends toward the inner side of the frame enclosed area.

According to an embodiment of the present application, one end of the first wide segment away from the first narrow segment is arranged with a first impedance matching assembly, the first impedance matching assembly is connected to one side of the first wide segment away from the second wide segment; one end of the second wide segment away from the second narrow segment is arranged with a second impedance matching assembly, the second impedance matching assembly is connected to one side of the second wide segment away from the first wide segment, and the second impedance matching assembly is symmetrically arranged with the first impedance matching assembly.

According to an embodiment of the present application, the first impedance matching assembly comprises the first impedance matching line, the second impedance matching line and the third impedance matching line arranged in parallel and all the first impedance matching line, the second impedance matching line and the third impedance matching line are perpendicular to the first wide segment and further comprises the fourth impedance matching line connected to one end of the first impedance matching line away from the first wide segment, one end of the second impedance matching line away from the first wide segment, and one end of the third impedance matching line away from the first wide segment in sequence;

alternatively, the first impedance matching assembly comprises one first impedance matching line perpendicular to the first wide segment, and one second impedance matching line connecting the first impedance matching line and the first wide segment, the connection point of the second impedance matching line and the first impedance matching line deviates from the connection point of the first impedance matching line and the first wide segment.

It is another aspect of the present invention to provide an antenna including the antenna element as described above.

An antenna element of implementing any embodiment of the present application has at least the following beneficial effects:

In the antenna element provided in this embodiment, the first trunk is divided into the first narrow segment and the first wide segment, and the second trunk is divided into the second narrow segment and the second wide segment, and the first narrow segment and the second narrow segment are arranged oppositely, the first wide segment and the second wide segment are arranged oppositely. In this way, the central conduction band of the antenna element forms a two-stage structure, and the length and width of the central conduction band of each stage and the slit width can be optimally arranged according to the impedance matching situation, which can greatly facilitate the impedance matching design of the antenna element; the first feed hole and the second feed hole are arranged on the first wide segment and the second wide segment, respectively. After the antenna element is connected to the control circuit through the first feed hole and the second feed hole, compared to the solution in which the first trunk and the second trunk are arranged in parallel and at fixed intervals, the antenna element provided in this embodiment has a better signal reception strength in the whole frequency band, especially for UHF (Ultra High Frequency) signals, which can reduce the standing wave ratio and significantly optimize the signal reception strength.

BRIEF DESCRIPTION OF THE DRAWINGS

In order to more clearly explain the technical solutions in the embodiments of the present application, the following will briefly introduce the drawings required in the embodiments. Obviously, the drawings in the following description are only some embodiments of the present application. Those skilled in this art can obtain other drawings based on these drawings without creative work.

Figure 1:
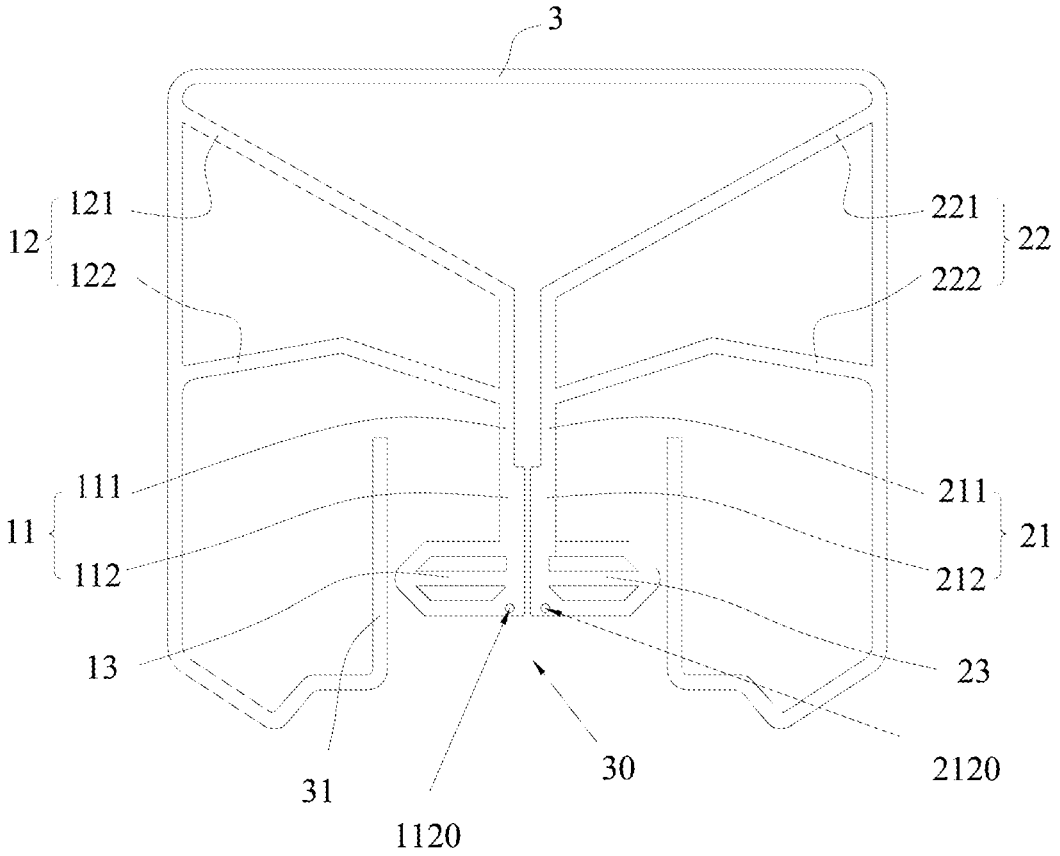
FIG. 1 is a schematic diagram of an antenna element constructed according to an embodiment of the present invention.

The details of the reference numbers involved in the above drawings are as follows:

11—first trunk; 111—the first narrow segment; 112—first wide segment; 1120—first feed hole; 12—first branch; 121—the first upper branch; 122—first lower branch; 13—first impedance matching assembly; 131—first impedance matching line; 132—second impedance matching line; 133—third impedance matching line; 134—fourth impedance matching line; 21—second trunk; 211—second narrow segment; 212—second wide segment; 2120—second feed hole; 22—second branch; 221—second upper branch; 222—second lower branch; 23—second impedance matching assembly; 3—frame; 30—notch; and 31—extension.

DETAILED DESCRIPTION OF THE EMBODIMENTS

In order to make the purpose, technical solutions and advantages of the present application more clear, the following describes the present application in further detail with reference to the accompanying drawings and embodiments. It should be understood that the specific embodiments described herein are only used to explain the present application, and are not used to limit the present application.

It should be noted that when a component is said to be "fixed" or "installed" on another component, it can be directly or indirectly located on the other component. When a component is said to be "connected to" another component, it can be directly or indirectly connected to the other component. The indicated orientation or position of the terms "upper", "lower", "left", "right", "front", "rear", "vertical", "horizontal", "top", "bottom", "inner", "outer", etc. is based on the orientation or position shown in the drawings, which is only for the convenience of description and cannot be understood as a limitation to the present technical solution. The terms "first" and "second" are used for descriptive purposes only, and cannot be understood as indicating or implying relative importance or implicitly indicating the number of technical features. The meaning of "a plurality of" is two or more, unless specifically defined otherwise.

In order to explain the technical solutions described in this application, the following detailed description will be made in conjunction with specific drawings and embodiments.

Referring to FIG. 1, it is one aspect of the present invention to provide an antenna element, which includes the first trunk 11 and the second trunk 21 which are arranged oppositely, a plurality of the first branches 12 connecting the first trunk 11, and a plurality of second branches 22 connecting the second trunk 21; the first trunk 11 comprises a first narrow segment 111 and a first wide segment 112 connecting the first narrow segment 111, and the second trunk comprises 21 a second narrow segment 211 and a second wide segment 212 connecting the second narrow segment 211, the first narrow segment 111 is disposed opposite to the second narrow segment 211, the first wide segment 112 is disposed opposite to the second wide segment 212; the first wide segment 112 defines a first feed hole 1120, the second wide segment 212 defines a second feed hole 2120 at a position opposite to the first feed hole 1120.

The implementation of the antenna element provided in this embodiment can at least achieve the following beneficial technical effects:

In the antenna element provided in this embodiment, the first trunk 11 is divided into the first narrow segment 111 and the first wide segment 112, and the second trunk 21 is divided into the second narrow segment 211 and the second wide segment 212, and the first narrow segment 111 and the second narrow segment 211 are arranged oppositely, the first wide segment 112 and the second wide segment 212 are arranged oppositely. In this way, the central conduction band of the antenna element forms a two-stage structure, and the length and width of the central conduction band of each stage and the slit width can be optimally arranged according to the impedance matching situation, which can greatly facilitate the impedance matching design of the antenna element; the first feed hole 1120 and the second feed hole 2120 are arranged on the first wide segment 112 and the second wide segment 212, respectively. After the antenna element is connected to the control circuit through the first feed hole 1120 and the second feed hole 2120, compared to the solution in which the first trunk 11 and the second trunk 21 are arranged in parallel and at fixed intervals, the antenna element provided in this embodiment has a better signal reception strength in the whole frequency band, especially for UHF (Ultra High Frequency) signals, which can reduce the standing wave ratio and significantly optimize the signal reception strength.

Figure 3:
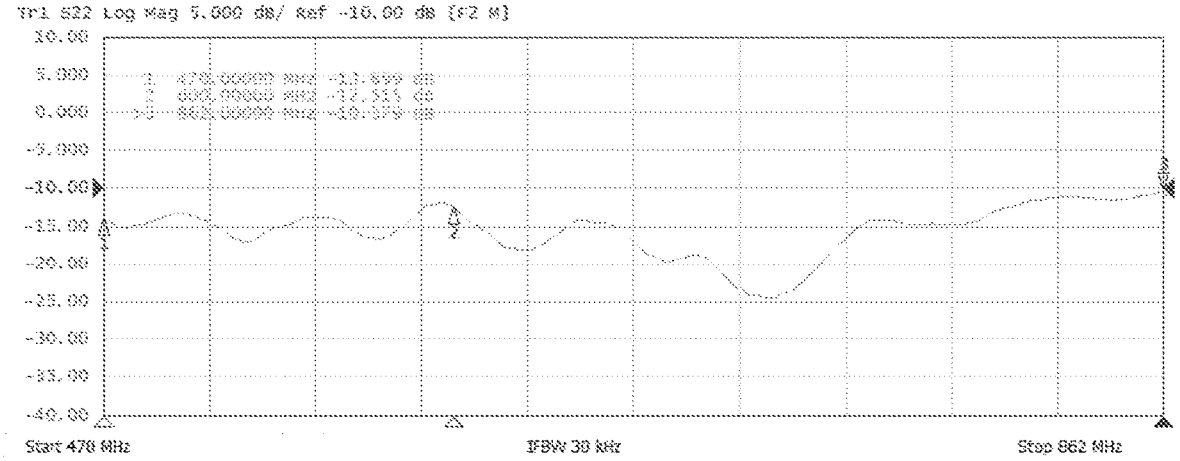
FIG. 3 is a schematic diagram of the relationship between the return loss and the frequency of the traditional antenna element.
Figure 4:
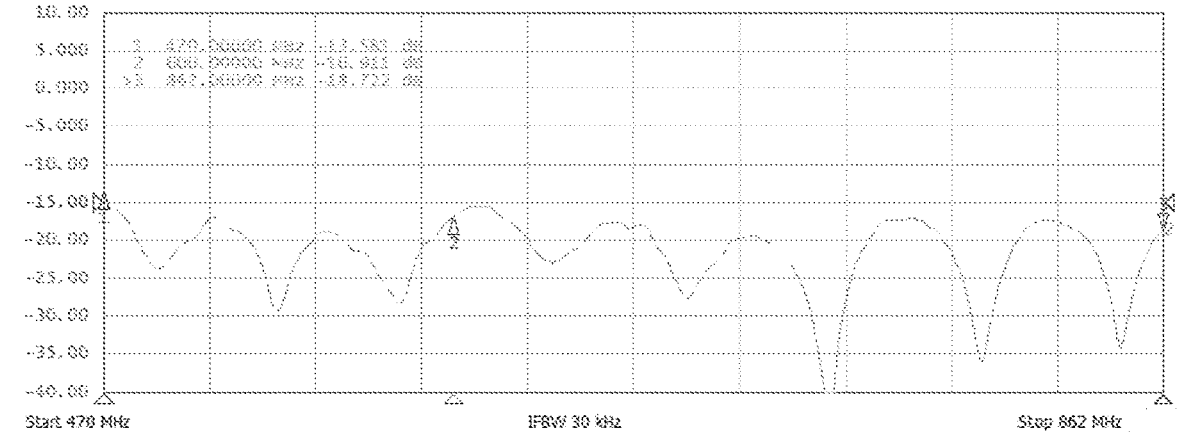
FIG. 4 is a schematic diagram of the relationship between the return loss and the frequency of the antenna element constructed according to an embodiment of the present invention.

Referring to FIGS. 3 and 4, where FIG. 3 is a schematic diagram of the relationship between the return loss and frequency of the traditional antenna element, and FIG. 4 is a schematic diagram of the relationship between the return loss and frequency of the antenna element provided by the embodiment of the present application, it can be clearly seen from FIGS. 3 and 4 that the antenna element provided by the embodiments of the present application is significantly better than the traditional antenna element in the return loss of each frequency band.

Figure 2:
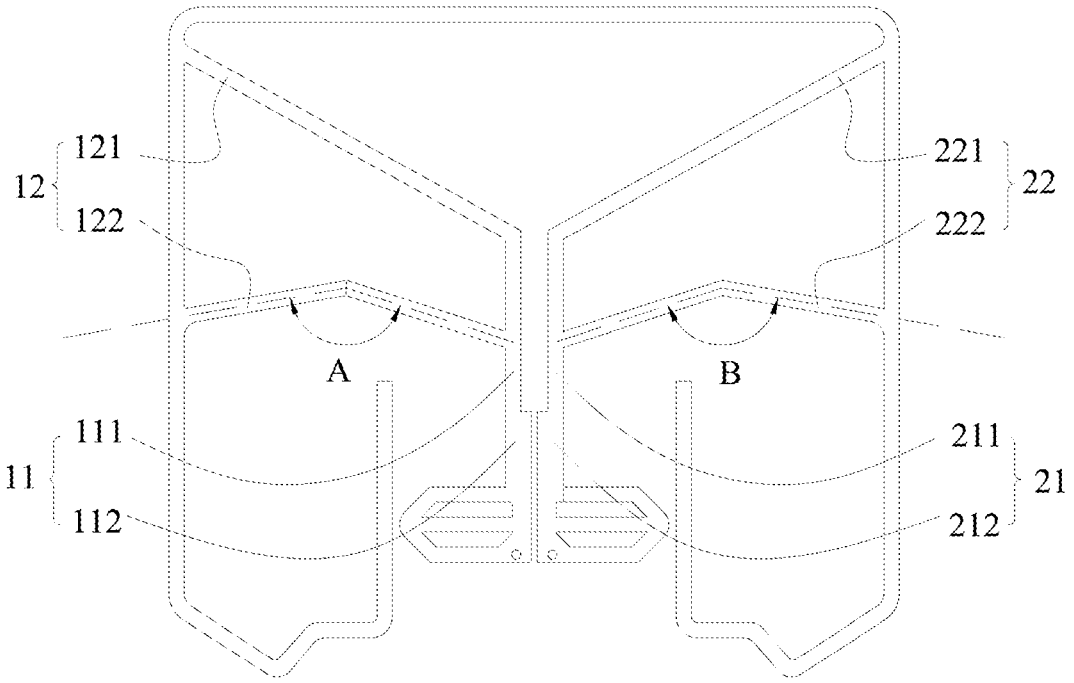
FIG. 2 is a schematic diagram of the angular relationship of the antenna element constructed according to an embodiment of the present invention.

Referring to FIGS. 1 and 2, in an embodiment of the present application, the first branch 12 is connected to the side of the first trunk 11 facing away from the second trunk 21, and the second branch 22 is connected to the side of the second trunk 21 facing away from the first trunk 11.

Actually, the design space of antenna element is very limited. By arranging the first branch 12 on the side of first trunk 11 facing away from the second trunk 21, and arranging the second branch 22 on the side of the second trunk 21 facing away from the first trunk 11, the antenna can be lengthened to match the VHF (Very High Frequency) signal, the resonance frequency of the antenna element can be reduced, and the low-frequency band of the antenna element can be widened.

Referring to FIG. 1, in an embodiment of the present application, a length of the first narrow segment 111 and a length of the second narrow segment 211 are equal, and a length of the first wide segment 112 and a length of the second wide segment 212 are equal; a ratio of the length of the first narrow segment 111 to the length of the first wide segment 112 is between 1:3 and 3:1, a ratio of the length of the second narrow segment 211 and the length of the second wide segment 212 is equal to the ratio of the length of the first narrow segment 111 to the length of the first wide segment 112.

If the length ratio of the first narrow segment 111 to the first wide segment 112 is too high, the return loss of 500-700 MHz will be deteriorated; otherwise, if the length ratio of the first narrow segment 111 to the first wide segment 112 is too low, the return loss of 700-862 MHz will be deteriorated. The length ratio of the first narrow segment 111 to the first wide segment 112 is within a reasonable range of 1:3-3:1, which can make the antenna element have a sufficiently excellent receiving capability for the entire frequency band.

As a specific solution of this embodiment, the first wide segment 112 and the second wide segment 212 have a length range of 45-55 mm, and the first narrow segment 111 and the second narrow segment 211 have a length range of 55-65 mm.

In an embodiment of the present application, the first narrow segment 111 and the second narrow segment 211 are parallel, the first wide segment 112 and the second wide segment 212 are parallel, and a distance between the first narrow segment 111 and the second narrow segment the segments 211 is larger than a distance between the first wide segment 112 and the second wide segment 212. A slit width formed between the first narrow segment 111 and the second narrow segment 211 and a slit width formed between the first wide segment 112 and the second wide segment 212 can be optimally set to adjust the impedance of the antenna element according to the lengths of the first narrow segment 111 and the first wide segment 112.

As a specific solution of this embodiment, the first narrow segment 111 and the second narrow segment 211 are parallel, and the distance between the first narrow segment 111 and the second narrow segment 211 is 8-10 mm; the first wide segment 112 and the second wide segment 212 are parallel, and the distance between the first wide segment 112 and the second wide segment 212 is 2-2.5 mm.

Referring to FIG. 1, in an embodiment of the present application, the first wide segment 112, the first narrow segment 111, the second wide segment 212, and the second narrow segment 211 all extend in the same direction, the first trunk 11 and the second trunk 21 are symmetrical to a perpendicular bisector of the line connecting the first feed hole 1120 and the second feed hole 2120. In this way, the first wide segment 112 and the first narrow segment 111 of the first trunk 11 are arranged in the same direction, and the first trunk 11 is parallel to the second trunk 21, and a higher reflection intensity can be obtained in a direction perpendicular to the first trunk 11. In the specific application process, for example, when the antenna element provided in this embodiment is used as a TV antenna, the first trunk 11 can be arranged vertically, so that the antenna element can obtain high signal strength in the horizontal direction, especially in the direction perpendicular to the plane of the antenna element, the antenna element has excellent signal transceiver capability in the direction of the surface.

Referring to FIG. 1, as a specific solution of this embodiment, the first branch 12 is connected to the side of the first narrow segment 111 facing away from the second narrow segment 211, and the second branch 22 is connected to the side of the second narrow segment 211 facing away from the first narrow segment 111. More preferably, the two first branches 12 are connected at different positions of the first narrow segment 111, and the second branch 22 and the first branch 12 are arranged symmetrically. In this way, the antenna can have multiple effective lengths, and the antenna element can be connected to more specific frequencies resonate, improving the full-band performance of the antenna element.

Referring to FIG. 1, in an embodiment of the present application, the first branch 12 includes a first upper branch 121 and a first lower branch 122, the second branch 22 includes the second upper branch 221 and second lower branch 222, and the first upper branch 121 is arranged on a side of the first lower branch 122 which is away from the first feed hole 1120, and the first upper branch 121 is a linear structure, the first lower branch 122 is a polyline structure, and the second branch 22 and the first branch 12 are symmetrically arranged. In this way, the first upper branch 121 and the second upper branch 221 are arranged symmetrically, and the first lower branch 122 and the second lower branch 222 are arranged symmetrically. By reasonable design, the antenna element can be resonated exactly in the UHF frequency band to avoid the resonance offset at the UHF frequency.

Referring to FIGS. 1 and 2, as a specific solution of this embodiment, the polyline angle A of the first lower branch 122 satisfies: 60°≤A<180°; the polyline angle B of the second lower branch 222 equals to the polyline angle A of the first lower branch 122. Such a configuration can ensure that the antenna element has excellent signal characteristics in both UHF and VHF bands, and is beneficial to the impedance matching design of the antenna element, and reduces the return loss of the UHF band when the objective size of the antenna element is limited. It should be noted that if the above included angle is too small, the UHF performance of the antenna element will be deteriorated; it can be understood that the included angle should be less than 180° to ensure the communication performance of the antenna in each frequency band.

Referring to FIGS. 1 and 2, as a preferred solution of this embodiment, the polyline angle A of the first lower branch 122 is in the range of 140°-160°, and the polyline angle B of the second lower branch 222 is in the range of 140°-160°. The polyline angle A of the first lower branch 122 and the polyline angle B of the second lower branch 222 are arranged within this angle range, which can optimize the impedance matching of the antenna element, reduce the standing wave ratio, and thereby improving the gain of the antenna element at UHF frequency band. Most preferably, the polyline angle A of the first lower branch 122 is 152°, and the polyline angle B of the second lower branch 222 is 152°.

Referring to FIG. 1, in an embodiment of the present application, the antenna element further includes a frame 3, which connects one end of the first branch 12 away from the first trunk 11, and the frame 3 connects one end of the second branch 22 away from the second trunk 21. The first feed hole 1120 is arranged at an end of the first wide segment 112 away from the first narrow segment 111, and the second feed hole 2120 is arranged at an end of the second wide segment 212 away from the second narrow segment 211. The frame 3 defines a notch 30 at a position opposite to the first power feed hole 1120 and the second power feed hole 2120. The frame 3 as a further extension of the first branch 12 and the second branch 22 can reduce the space occupied by the antenna element, and at the same time, further increase the effective length of the antenna structure of the antenna element in a limited space, so that the antenna element can resonate with the signals in the low frequency band and can get a better response to the VHF frequency band.

Referring to FIG. 1, in one embodiment of the present application, the frame 3 includes an extension 31 for adjusting the resonance frequency of the antenna element, the extension 31 is connected to the edge of the notch 30, and the extension 31 extends toward an inner portion of an area enclosed by the frame 3. Such an arrangement further extends the effective length of the antenna structure in a limited space, improves the space utilization of the antenna element, enables the antenna element to resonate with signals in lower frequency bands, and can obtain a better response to the VHF frequency band, and reduce the space occupied by the antenna element at the same time.

Referring to FIG. 1, in an embodiment of the present application, one end of the first wide segment 112 away from the first narrow segment 111 is provided with a first impedance matching assembly 13, the first impedance matching assembly 13 is connected to a side of first wide line the portion 112 away from the second wide segment 212; one end of the second wide segment 212 away from the second narrow segment 211 is provided with a second impedance matching assembly 23, the second impedance matching assembly 23 is connected to a side of the second wide line the portion 212 away from the first wide segment 112, and the second impedance matching assembly 23 and the first impedance matching assembly 13 are symmetrical to the perpendicular bisector of the line connecting the first feed hole 1120 and the second feed hole 2120. The first impedance matching assembly 13 and the second impedance matching assembly 23 may use an impedance matching line, an impedance matching frame, or other complex or irregular shapes. The arrangement of the impedance matching assembly can further optimize the wave loss of the antenna element in the UHF band and improves transceiver ability to signals.

Figure 5:
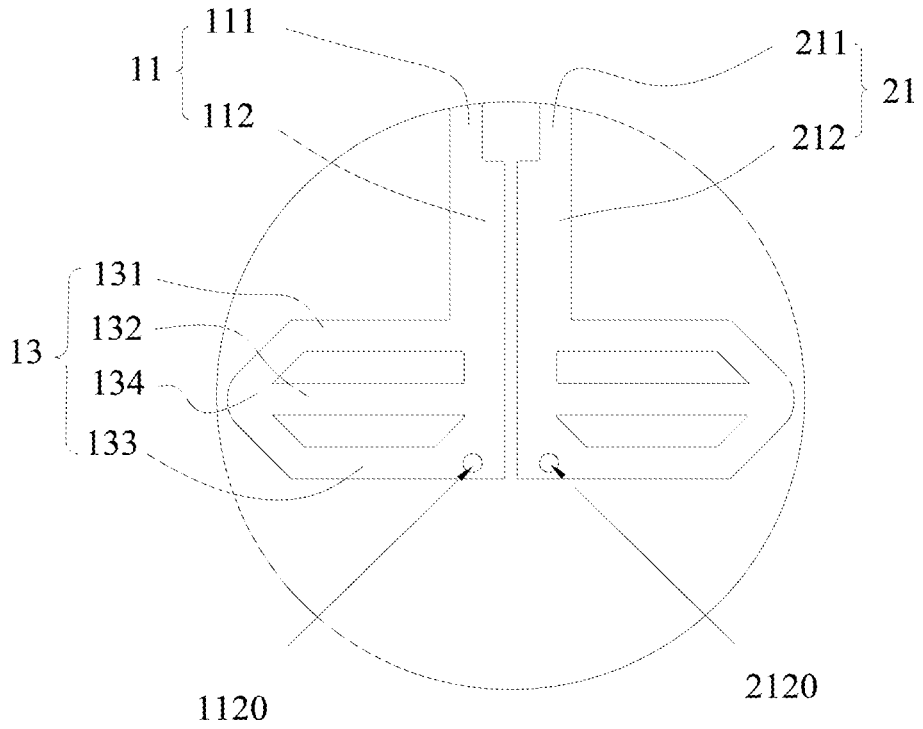
FIG. 5 is a schematic diagram of the first impedance matching assembly and the second impedance matching assembly constructed according to an embodiment of the present invention.

In an embodiment of the present application, referring to FIG. 5, the first impedance matching assembly 13 includes the first impedance matching line 131, the second impedance matching line 132 and the third impedance matching line 133 which are arranged in parallel and perpendicular to the first wide segment 112; the first impedance matching assembly 13 further includes the fourth impedance matching line 134 connected to one end of the first impedance matching line 131 away from the first wide segment 112, one end of the second impedance matching line 132 away from the first wide segment 112, and one end of the third impedance matching line 133 away from the first wide segment 112 in sequence. The second impedance matching assembly 23 and the first impedance matching assembly 13 are symmetry to the perpendicular bisector of the line connecting the first feed hole 1120 and the second feed hole 2120.

Figure 6:
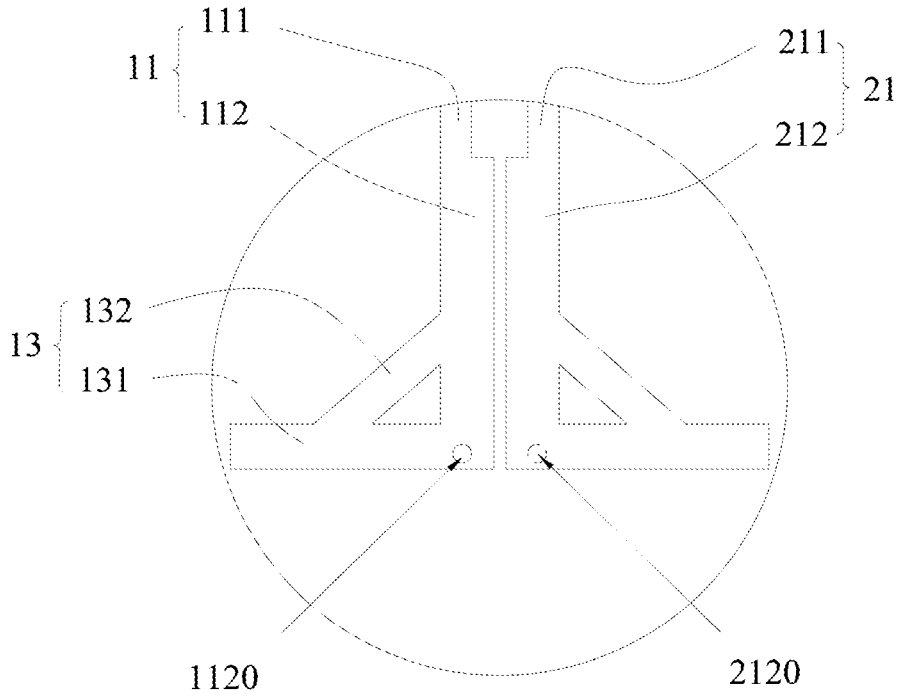
FIG. 6 is a schematic diagram of the first impedance matching assembly and the second impedance matching assembly constructed according to an embodiment of the present invention.
Figure 7:
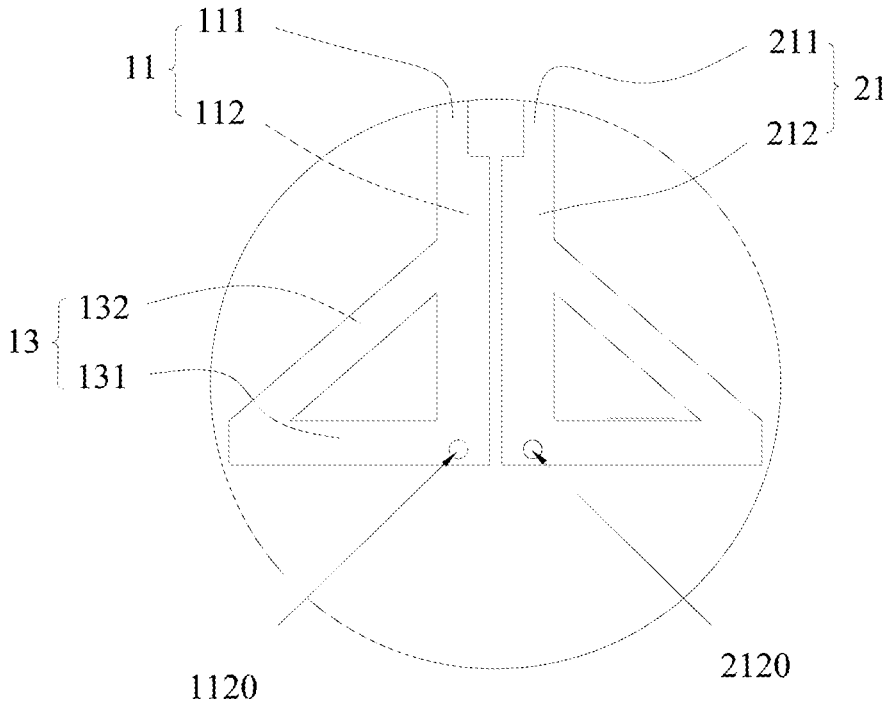
FIG. 7 is a schematic diagram of the first impedance matching assembly and the second impedance matching assembly constructed according to an embodiment of the present invention.

Alternatively, referring to FIG. 6 and FIG. 7, the first impedance matching assembly 13 includes the first impedance matching line 131 perpendicular to the first wide segment 112, and the second impedance matching line 132 connecting the first impedance matching line 131 and the first wide segment 112. A connection point of the second impedance matching line 132 and the first impedance matching line 131 deviate from a connection point of the first impedance matching line 131 and the first wide segment 112, the second impedance matching assembly 23 and the first impedance matching assembly 13 is symmetrical to the perpendicular bisector of the line connecting the first feed hole 1120 and the second feed hole 2120.

The antenna element provided in the embodiments of the present application may be formed integrally by casting, or may be provided on a copper-clad laminate, PVC (polyvinyl chloride) or other material substrate by electroplating or printing. The antenna element can also be formed by cutting a metal sheet.

Another aspect of the present invention is to provide an antenna including the antenna element as described above. The antenna may be a planar antenna, or may be a linear antenna, which is bent or integrally formed, and provided in a housing or a bracket.

The antenna element provided by the embodiments of the present application is particularly applicable for television antennas, and can be adapted to television signals in various signal bands through a reasonable design The above are only optional embodiments of this application and are not intended to limit this application. Any modifications, equivalent replacements and improvements made within the spirit and principles of this application should be included in the protection range of this application.

What is claimed is:

1. An antenna element, comprising:

a first trunk and a second trunk arranged oppositely, a plurality of first branches connecting to the first trunk, and a plurality of second branches connecting to the second trunk;

the first trunk comprising a first narrow segment and a first wide segment connecting with the first narrow segment, and the second trunk comprising a second narrow segment and a second wide segment connecting with the second narrow segment;

wherein the first narrow segment is disposed opposite to the second narrow segment, and the first wide segment is disposed opposite to the second wide segment; and the first wide segment defines therein a first feed hole, and the second wide segment defines therein a second feed hole at a position opposite to the first feed hole.

2. The antenna element according to claim 1, wherein a length of the first narrow segment and a length of the second narrow segment are equal, and a length of the first wide segment and a length of the second wide segment are equal; and a ratio of the length of the first narrow segment to the length of the first wide segment is between 1:3 and 3:1.

3. The antenna element according to claim 1, wherein the first narrow segment and the second narrow segment are parallel, and a distance between the first narrow segment and the second narrow segment is 8-10 mm; and the first wide segment and the second wide segment are parallel, and a distance between the first wide segment and the second wide segment is 2-2.5 mm.

4. The antenna element according to claim 1, wherein the first branch comprises a first upper branch and a first lower branch, and the first upper branch is disposed on a side of the first lower branch which is away from the first feed hole, and the first upper branch is of a linear structure, and the first lower branch is of a polyline structure; and the second branch comprises a second upper branch and a second lower branch, the second upper branch is disposed on a side of the second lower branch which is away from the second feed hole, and the second upper branch is of a linear structure, and the second lower branch is of a polyline structure.

5. The antenna element according to claim 4, wherein a polyline angle A of the first lower branch meets: $60° \leq A < 180°$; and a polyline angle B of the second lower branch is equal to the polyline angle A of the first lower branch.

6. The antenna element according to claim 1, further comprising a frame, wherein the frame is connected to an end of each first branch away from the first trunk, and the frame is connected to an end of each second branch away from the second trunk.

7. The antenna element according to claim 6, wherein the first feed hole is arranged at an end of the first wide segment away from the first narrow segment, the second feed hole is arranged at an end of the second wide segment away from the second narrow segment;

the frame is provided with a notch at a position opposite to the first power feed hole and the second feed hole; and the frame comprises an extension for adjusting a resonance frequency of the antenna element, the extension is connected to an edge of the notch, and the extension extends toward an inner portion of an area enclosed by the frame.

8. The antenna element according to claim 1, wherein an end of the first wide segment away from the first narrow segment is arranged with a first impedance matching assembly, the first impedance matching assembly is connected to a side of the first wide segment away from the second wide segment; and an end of the second wide segment away from the second narrow segment is arranged with a second impedance matching assembly, the second impedance matching assembly is connected to a side of the second wide segment away from the first wide segment, and the second impedance matching assembly is symmetrically arranged with the first impedance matching assembly.

9. The antenna element according to claim 8, wherein the first impedance matching assembly comprises a first impedance matching line, a second impedance matching line, and a third impedance matching line that are all arranged in parallel and perpendicular to the first wide segment, and the first impedance matching assembly further comprises a fourth impedance matching line connected to one end of the first impedance matching line away from the first wide segment, one end of the second impedance matching line away from the first wide segment, and one end of the third impedance matching line away from the first wide segment in sequence;

or alternatively, the first impedance matching assembly comprises one first impedance matching line perpendicular to the first wide segment, and one second impedance matching line connecting the first impedance matching line and the first wide segment, and a connection point of the second impedance matching line and the first impedance matching line deviates from a connection point of the first impedance matching line and the first wide segment.

10. An antenna, comprising the antenna element according to claim 1.

* * * * *